US006130411A

United States Patent [19]

Rockenfeller et al.

[11] Patent Number: 6,130,411

[45] Date of Patent: Oct. 10, 2000

[54] GOLF BALL HEATER APPLIANCE

[75] Inventors: Uwe Rockenfeller; Paul Sarkisian, both of Boulder City, Nev.

[73] Assignee: Rocky Research, Boulder City, Nev.

[21] Appl. No.: 09/421,606

[22] Filed: Oct. 20, 1999

[51] Int. Cl.[7] ..... H05B 3/06; F27D 11/02

[52] U.S. Cl. ..... 219/392; 219/386; 219/521; 219/524

[58] Field of Search ..... 219/385, 386, 219/214, 392, 521, 524, 525; 222/146.5

[56] References Cited

U.S. PATENT DOCUMENTS

| | | | |
|---|---|---|---|
| 1,939,017 | 12/1933 | Naeve | 219/524 |
| 3,497,676 | 2/1970 | Gravatt | 219/521 |
| 3,683,155 | 8/1972 | Loofbourow | 219/521 |
| 3,746,837 | 7/1973 | Frey et al. | 219/387 |
| 3,831,001 | 8/1974 | Toomey et al. | 219/521 |
| 4,049,949 | 9/1977 | Fitzsimons | 219/386 |
| 4,155,002 | 5/1979 | Cohen | 219/521 |
| 4,420,681 | 12/1983 | Arnold | 219/521 |
| 4,967,062 | 10/1990 | Cohen | 219/521 |
| 5,998,771 | 12/1999 | Mariano et al. | 219/528 |

FOREIGN PATENT DOCUMENTS 60-124386 7/1985 Japan .

*Primary Examiner*—Joseph Pelham
*Attorney, Agent, or Firm*—Knobbe, Martens, Olson & Bear, LLP

[57] ABSTRACT

The hitting distance performance of a golf ball is improved by heating the ball to an average temperature of between 30° C. and 55° C. during an active heating period of 30 minutes or less followed by a temperature equilibration period of 20 minutes or less. A golf ball heating appliance for carrying out the process has an upper and lower receptacle for receiving a plurality of golf balls and includes an electrical heating element capable of delivering at least 2 watts, and preferably, 4 watts of power per ball during the active heating period.

31 Claims, 1 Drawing Sheet

GOLF BALL HEATER APPLIANCE

BACKGROUND OF THE INVENTION

It is known that golf balls heated to temperatures between about 30° C. and about 50° C. have improved performance as evidenced by the greater distance a warm or hot ball will travel as compared to a cold ball when hit with the same driving force. The temperature effect is most pronounced on wound balls, which are technically superior and preferred by golfers interested in maximizing golf ball driving distance performance.

A number of prior art heating devices have been proposed to take advantage of the aforesaid performance improving heating effect. Most of the proposed heaters use hot air for heating the balls, for example, as disclosed in U.S. Pat. Nos. 3,683,155, 4,420,681, 4,967,062 and 5,057,670. According to the aforesaid patents the golf balls are intentionally heated relatively slowly to temperatures of up to about 120° F. (48.9° C.) for at least about six hours or longer (U.S. Pat. No. 3,831,001) and up to two days or longer (U.S. Pat. No. 3,683,155) prior to use. For most golfers, such heating times are often impractical. The heated balls must also be maintained at the desired elevated temperatures until they are ready for use, thus requiring continued heating or storing the balls in a well-insulated container.

SUMMARY OF THE INVENTION

The present invention is directed to a method for improving golf ball distance performance by heating the golf ball to an average temperature of between 25° C. and about 55° C. within 30 minutes or less, and to an appliance for carrying out the method. The process is carried out in two steps or stages: an active heating stage followed by a temperature equilibration stage. The golf ball heating appliance of the present invention is capable of simultaneously heating a plurality of golf balls to an average temperature of at least 25° C. in 30 minutes or less, typically the time it takes for a golfer to drive from home to a golf course. The heating appliance, designed for holding a plurality of balls, heats the balls primarily by conduction from the heated surface of a spherical cavity which encases each golf ball. The appliance of the invention is also capable of maintaining the temperature of the heated golf ball for at least about 2 hours and preferably for about 4 hours after the power to the heating element is terminated. The heating appliance comprises upper and lower receptacles having opposite and facing semi-spherical cavities for holding the respective balls, and a resistive heating element cooperating with a thermally conductive material of which the receptacles are made. More specific details and features of the method and golf ball heating appliance of the invention will be described in the detailed description.

DETAILED DESCRIPTION OF THE INVENTION

Figure 1:
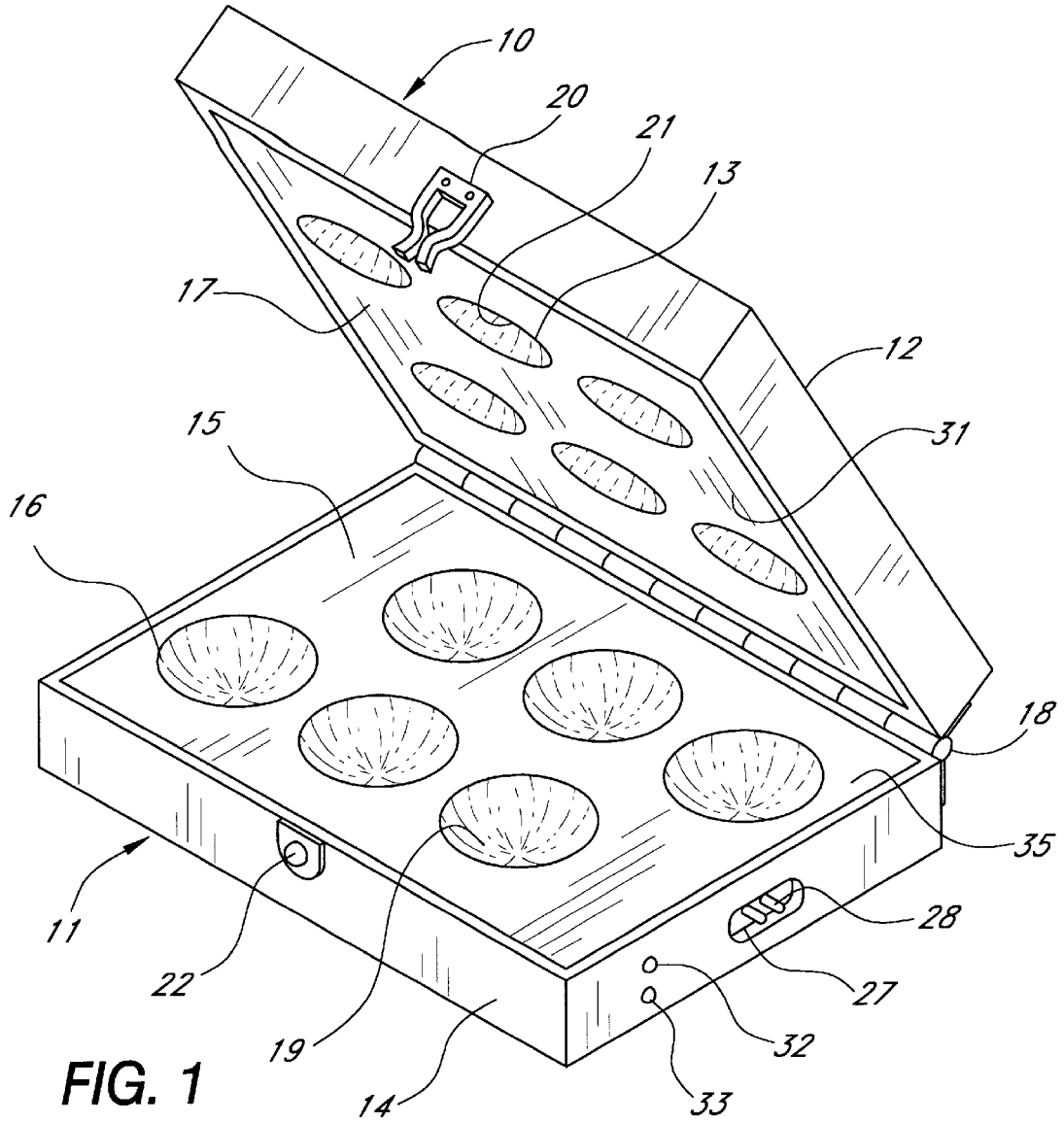
FIG. 1 is a perspective view of the golf ball heating appliance of the invention illustrating the interior including the golf ball holding cavities.

The invention is primarily useful in locations where the daytime temperature is 25° C. or below, as well as where golf balls cool to below 25° C. overnight, for example, where stored in a vehicle or garage where cooler nighttime temperatures cause cooling of the balls to below 25° C.

The process of the invention is in heating one or more golf balls to an average ball temperature of at least 25° C. and up to about 55° C., preferably between 28° C. and 48° C., within 40 minutes or less, preferably 30 minutes or less. The average ball temperature takes into account the temperature of the cover as well as the internal ball temperature, i.e., the mean temperature of the mass of the ball. A first step is an active heating phase during which heat is applied to the exterior surface of the ball using a heater appliance described hereinafter, followed by a second phase in which the temperature of the ball is equilibrated. In the first phase heat is applied to the ball at a level of 2 watts, preferably 4 watts or more per ball, for 30 minutes or less, preferably 20 minutes or less. During the active heating period, a cover or surface ball temperature above 75° C. is to be avoided and preferably does not exceed 70° C. The specific heating time will depend on the amount of energy or wattage applied to each ball, and the temperature of the ball before heating. Generally, during the active heating period, the ball cover surface temperature will increase at an average rate of between about 0.5° C./min/watt and about 0.75° C./min/watt. Thus, for example, where the initial average ball temperature is 5° C. and 2 watts per ball energy is applied, an active heating period of 40 minutes could be used, heating the outside cover to about 47° C., followed by an equilibration period of 10 to 15 minutes to achieve an average or equilibrated ball temperature of about 40° C. Similarly, if 3 watts per ball is applied to a 5° C. ball, a suitable active heating period of 25 minutes and equilibration period of about 15 minutes will produce a 40° C. ball. At 4 watts per ball, an active heating period of about 18 minutes and an equilibration period of about 15 minutes will produce a 40° C. ball. It will be understood that the above times and temperatures are approximate and balls from different manufacturers will produce slightly different results. A suitable equilibration period is between about 5 and about 30 minutes, and preferably is 15 minutes or less. At complete equilibration, the internal and surface ball temperatures are substantially equal. However, for purposes of the process of the invention, the equilibration step will yield a difference of internal and external (surface) ball temperature of 5° C. or less and a ball surface temperature of less than about 55° C.

The golf ball heating appliance illustrated in FIG. 1 includes a top assembly 10 and a bottom assembly 11, each containing a receptacle having a plurality of semi-spherical cavities. The top assembly 10 includes a lid 12 and an upper receptacle 31 in which are formed a plurality of semi-spherical cavities 13. The bottom assembly 11 includes a base 14 in which a lower receptacle 35 is secured, also having a plurality of semi-spherical cavities 16.

Figure 2:
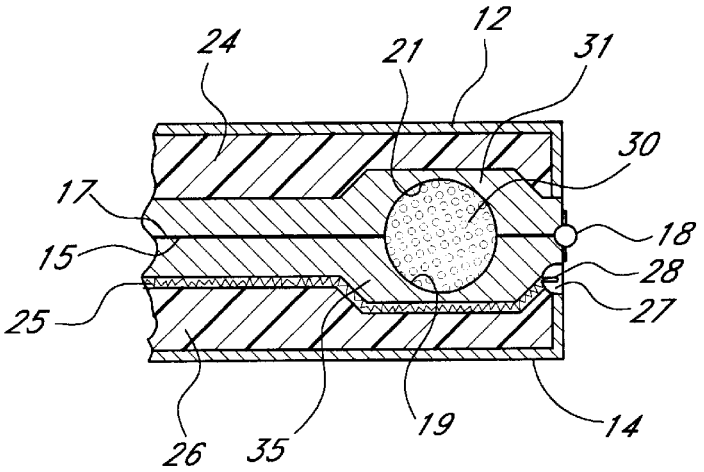
FIG. 2 is a partial sectional view illustrating the golf ball holding appliance in a closed condition with a golf ball located in one of the spherical heating cavities.

Referring also to FIG. 2, each of the semi-circular cavities are sized or dimensioned to be slightly oversized from one-half of the spherical surface of a golf ball. When the appliance is closed with the upper and lower housing members meeting, the facing surfaces 17 and 15 of the upper and lower receptacles 31 and 35 are in substantial contact and opposite and facing semi-spherical cavities form a spherical chamber in which a golf ball is held. The slightly oversized cavities provide for contact of a major amount of the golf ball surface with the interior surface of the upper and lower semi-spherical cavities. Such a feature is illustrated in FIG. 2 in which the golf ball 30 is shown as in substantial physical contact and conductive engagement with the interior surfaces 19 and 21 of the respective lower and upper cavities 16 and 13. Substantial and major golf ball surface contact ensures more efficient and rapid heating by conduction as compared to conventional heating devices which use hot air as the primary means for heating the surface of the ball.

The upper and lower receptacles 31, 35 comprise a thermally conductive material, such as aluminum or copper or other metals or metal alloys or carbon or graphite composites which efficiently conduct heat from a heating element cooperating and in contact with a receptacle to the golf ball. A conductive receptacle is important so that golf balls placed in the cavities will become efficiently and rapidly heated in the active heating stage to the desired average temperature of at least about 25° C. up to about 55° C. within a relatively short period of time of 30 minutes or less, but without heating the surface of the ball above 75° C. and preferably does not exceed 70° C. to avoid thermal degradation, deformation or damage to the outer surface of the ball. The upper and lower receptacles may be made of a block or thick portion of aluminum, copper or other efficient heat conducting metal as illustrated in FIG. 2. Alternatively, the receptacles may be formed of a sheet of aluminum, copper or other heat conductive metal with upper and lower insulation inserts 24, 26, respectively, used to substantially fill the space between the housing members and the receptacles. Combinations of different metals may also be used in forming the upper and lower receptacles. Another material having excellent thermal properties comprises a carbon or graphite foam composition. Because carbon foam has substantially reduced density as compared to aluminum or copper the use of such a material may be preferred where high thermal conductivity and weight reduction is desired. The highly thermal conductive foam may be also used in a laminate or sandwich structure for improving mechanical properties. A specific material of this type is described as foam core sandwich panel made from thermal conductive mesophase pitch-based carbon foam developed by Oak Ridge National Laboratory, Oak Ridge, Tenn. Such a panel comprises a laminate in which the carbon foam is sandwiched between outer layers of aluminum or copper secured to the foam with an adhesive.

The upper and lower housing members must also be sufficiently insulative so as to adequately maintain the temperature of the heated balls for at least about 2 hours after the power to the heating element is terminated. The appliance of the invention is preferably capable of maintaining balls that are heated and equilibrated to about 48° C. for about 4 hours above about 25° C. after power to the heating element is terminated. More preferably, the insulation will provide golf ball heat loss at a rate of less than an average of 6° C./hr in a 15° C. ambient environment. The specific insulating material to achieve such an insulation factor combined with the insulation factor of the material of which the upper and lower housing members are formed may be selected by those skilled in the art. The rate of temperature loss of the golf balls may also be reduced by incorporating a high heat capacity or phase-change material or materials within the apparatus, such as in the upper and/or lower housing member. Suitable materials include water as well as hydrated salts and eutectic salts or other phase-change materials known to those skilled in the art. Most preferred phase-change materials are those having phase-change in the temperature range of 25° C. to 75° C.

As seen in FIGS. 1 and 2 each of the upper and lower receptacles have a substantial planar surface area interrupted only by the circular cavity openings. When the appliance is fully closed, the upper and lower receptacle planar surfaces meet and contact along a substantial portion of their surface areas as illustrated in FIG. 2 whereby heat is efficiently transferred between the two contacting surfaces. Because of such contact, a single heating element 25 may be used in either the top or bottom assembly. One or more heating elements may be used in either upper and/or lower assemblies which elements must be in sufficient contact with the thermally conductive metal receptacle in the assembly in which they are present to efficiently and adequately direct the heat to the golf balls present in the respective spherical cavities.

As illustrated in FIGS. 1 and 2, the heating element 25 is provided with plugs 28 for receiving a power cord inserted into the electric receptacle 27 from a power supply source, for example, a 110–120 volt AC power supply. Alternatively, power may be supplied to the heating element from a DC power source, such as a 6 or 12 volt battery or a battery pack or the like. The power supply and heating element used in the heater of the invention are capable of delivering at least 2 watts and up to 15 watts of energy to each of a plurality of golf balls, preferably 3 watts per ball and more preferably 4 or more watts per ball in each of the cavities. Thus, for example, where the appliance is capable of holding 4 golf balls, a preferred appliance is capable of delivering 12 watts of power and, more preferably, 16 watts. A most preferred appliance will be capable of holding up to 6 balls thereby requiring a power capacity of at least 12 watts, preferably 18 watts and, most preferably 24 or more watts up to about 75 watts of power accounting to losses to the ambient from the appliance. The greater the power supply capability of the device, the faster the balls can be heated. As previously noted, the appliance of the invention is capable of producing a plurality of balls having the desired average temperature of at least 25° C. and preferably up to 48° C. and as high as 55° C. within about 30 minutes from the time the power is initially supplied to the ambient temperature balls and without overheating the surface of the balls. Of course, the lower the ambient or initial ball temperature, the greater the length of time required for heating the balls to the desired average temperature range. However, a preferred appliance is capable of heating the plurality of golf balls from ambient temperature of about 4° C. or more to at least 25° C. in 30 minutes, or less. The preferred appliance of the invention is capable of delivering at least about 0.54 Btu/hr in$^2$, and more preferably 0.97 Btu/hr in$^2$ up to about 2.71 Btu/hr in$^2$ of golf ball surface. The capability of the heating apparatus to heat a ball from ambient of less than 25° C., and usually 20° C. or less, is responsive to the average or typical time it takes to drive a vehicle to a golf course or driving range. With such a heating capability, the heating appliance may be conveniently powered from the cigarette lighter outlet of the automobile for 30 minutes or less during the drive to the golf course. Again, the active heating phase during which the internal ball temperature is elevated from below 25° C. to the aforesaid range also avoids heating the ball surface at temperatures above 75° C.

Other preferred features of the appliance of the invention include a temperature sensor and power supply cutoff cooperating with the one or more heating elements which components will prevent overheating of the golf balls. Preferably, such components will prevent the golf balls from being heated above an average temperature of about 55° C. (131° F.) and/or a surface temperature of above 75° C., at which temperature or temperatures the power is automatically terminated. These cutoff and temperature sensing components may also allow the power to be turned on or resumed when the golf balls cool to a certain temperature, for example, at 25° C., at which temperature power to the heating element will be supplied. Thus, some maintenance heating may be provided after the initial or active heating period of 30 minutes or less, but only for maintaining internal ball temperatures within the desired range until the ball is ready for play. Other preferred components include a visible light 32 which is illuminated when power is supplied to the heating element, indicating to an observer that the golf balls have not yet reached a preset or maximum temperature and are still being heated. A stand-by light 33 may also optionally be installed for being illuminated when the golf balls have been heated to the desired temperature and may be set to remain illuminated so long as the golf balls are at or above the minimum temperature of 25° C. Such lights or other equivalent visible means for indicating the supply of power and temperature condition of the golf balls may be electrically connected to the temperature sensor such as a thermister, thermometer, or equivalent temperature sensing component capable of sensing the temperature of the surface of the golf balls present in the appliance. Of course, such a temperature sensing device need not be present or installed in each of the golf ball holding cavities since heating will be substantially uniform throughout the apparatus along the surface of the respective upper and lower receptacles as long as the appliance remains closed. Selection, positioning and number of thermisters or other temperature sensing devices will be understood by those skilled in the art. Also illustrated in FIG. 1 are upper and lower latch members 20 and 22, respectively, preferably capable of mating engagement for selectively locking and unlocking the upper and lower assemblies between an open condition and fully closed condition as previously described. A hinge 18 allows the appliance to be conveniently opened and closed. Clamps or latches for securing the upper and lower components may also be used.

What is claimed is:

1. A method for improving the driving distance of a golf ball comprising heating a golf ball having a temperature of less than 25° C. to an average temperature of between 25° C. and about 55° C. during an active heating period of 30 minutes or less by delivering at least 2 watts of energy to said ball during the active heating period, equilibrating the temperature of said ball without active heating for 20 minutes or less, and maintaining the ball at an average temperature of between 25° C. and 55° C. until the ball is put into play.

2. A method of claim 1 wherein the ball is heated to a temperature of between 28° C. and 48° C. during said active heating period.

3. A method of claim 1 wherein said active heating period is 20 minutes or less.

4. A method of claim 1 wherein said active heating is carried out by delivering between 0.54 and 2.71 Btu/hr in$^2$ to the surface of said ball during the heating period.

5. A method of claim 1 wherein the heated golf ball is maintained in said temperature range at an average heat rate loss of less than 6° C./hr.

6. A method of claim 1 wherein the temperature of the outer surface of said ball does not exceed 70° C. during said active heating period.

7. A method of claim 1 wherein the temperature equilibration results in a temperature difference at the center of the ball and the outer surface of the ball of less than about 5° C.

8. A method of claim 7 wherein the temperature equilibration period is 15 minutes or less.

9. A method for improving the driving distance of a golf ball having an average temperature of less than 25° C. comprising heating said ball to a surface temperature of less than 75° C. by delivering between 0.54 and 2.71 Btu/hr in$^2$ to the surface of said ball during an active heating period of 30 minutes or less, equilibrating the temperature of said ball to an average temperature range of between 25° C. and 55° C., and maintaining said ball at said average temperature range until it is to be played.

10. A method of claim 9 wherein the heated golf ball is maintained in said average temperature range at an average heat rate loss of less than 6° C./hr.

11. An apparatus for heating a plurality of golf balls comprising a thermally conductive receptacle having a plurality of ball receiving cavities and one or more heaters cooperating therewith capable of delivering at least about 0.54 Btu/hr in$^2$ of golf ball surface for each of said plurality of golf balls in each of said cavities.

12. An apparatus of claim 11 having a capability of delivering up to 2.71 Btu/hr in$^2$ of golf ball surface.

13. An apparatus of claim 12 having a capability of delivering at least about 0.97 Btu/hr in$^2$ of golf ball surface.

14. An apparatus of claim 11 wherein said one or more heaters have a total heating capacity of between 2 and 15 watts per ball.

15. An apparatus of claim 12 wherein said one or more heaters have a total heating capacity of between 3 and 12 watts per ball.

16. A golf ball heating appliance comprising:

a lower and an upper receptacle each having the same number of a plurality of substantially identical semi-spherical cavities each cavity for receiving one of a plurality of golf balls, wherein said cavities in said upper receptacle are opposite and facing said cavities in said lower receptacle, and wherein each of said semi-spherical cavities are dimensioned to make physical contact with at least a major portion of the exterior surface of a golf ball, and wherein said opposite and facing cavities form a spherical cavity when said apparatus is closed, said upper and lower receptacles comprising a thermally conductive material having a conductivity capable of delivering at least 0.54 Btu/hr in$^2$ to a golf ball in each of said cavities, and one or more resistive heater elements in thermal contact with said upper and/or said lower receptacle, said heater element having a capability of supplying at least 2 watts per golf ball, and wherein said one or more heater elements and said upper and lower receptacles are capable of heating said plurality of golf balls from ambient temperature of about 4° C. or more to an average temperature of at least 25° C. in 30 minutes or less.

17. A golf ball heating appliance of claim 16 wherein said upper and lower receptacles include top and bottom housing members respectively, comprising a thermally insulative material, and wherein the appliance is capable of maintaining the average temperature of balls heated therein to about 55° C. at an average temperature of at least about 25° C. for about 4 hours after power to said one or more resistive heating elements is terminated.

18. A golf ball heating appliance of claim 17 wherein said one or more heater elements are capable of supplying about 4 watts per golf ball.

19. A golf ball heating appliance of claim 16 wherein said upper and said lower receptacles comprise a sheet of said thermally conductive metal and wherein each of said sheets have a surface having substantially planar surface portions thereon for contact with the substantially planar surface portions of the other of said sheets.

20. A golf ball heating appliance of claim 16 comprising at least four of said ball receiving cavities.

21. A golf ball heating appliance of claim 16 including an adapter cooperating with said one or more resistive heater elements for supplying power thereto from a DC power source.

22. A golf ball heating appliance of claim 16 including an adapter cooperating with said one or more resistive heater elements for supplying power thereto from a 110–120 V AC power source.

23. A golf ball heating appliance of claim 16 including temperature sensor and power supply cutoff cooperating with said one or more heater elements for preventing heating thereof above about 55° C.

24. A golf ball heating appliance of claim 16 wherein said upper and said lower receptacles each comprise a sheet of said thermally conductive metal, and a first space between said upper receptacle and said top housing member and a second space between said lower receptacle and said bottom housing member, and insulation in said first and said second space capable of maintaining the temperature of golf ball therein heated to about 55° C. at a temperature of at least about 20° C. for about 2 hours after power to said one or more resistive heater elements is terminated.

25. A golf ball heating appliance of claim 16 wherein said thermally conductive material comprises carbon or graphite foam.

26. A golf ball heating appliance of claim 16 wherein said thermally conductive material is mesophase pitch-based carbon foam.

27. A golf ball heating appliance of claim 16 wherein said thermally conductive material comprises a carbon foam laminated between sheets of aluminum or copper.

28. A golf ball heating appliance of claim 16 wherein said thermally conductive material comprises aluminum or copper.

29. A golf ball heating appliance of claim 16 wherein said insulation is capable of preventing heat loss of a heated golf ball therein at a rate of greater than 6° C./hr.

30. A golf ball heating appliance of claim 16 wherein said upper and/or lower receptacles include a high heat capacity material therein.

31. A golf ball heating appliance of claim 16 wherein said upper and/or lower receptacles include a phase-change material therein.

* * * * *